United States Patent [19]

Peters

[11] Patent Number: 4,654,895

[45] Date of Patent: Apr. 7, 1987

[54] GLOVE

[76] Inventor: John P. Peters, 274 Brompton Rd., Williamsville, N.Y. 14221

[21] Appl. No.: 896,849

[22] Filed: Aug. 15, 1986

[51] Int. Cl.[4] ..... A47D 19/00

[52] U.S. Cl. ..... 2/161 A

[58] Field of Search ..... 2/158, 159, 160, 161 R, 2/161 A, 162, 163, 164, 19

[56] References Cited

U.S. PATENT DOCUMENTS 4,565,195 1/1986 Eisenberg ..... 2/161 A

FOREIGN PATENT DOCUMENTS 1252680 11/1971 United Kingdom ..... 2/161

*Primary Examiner*—Doris L. Troutman

*Attorney, Agent, or Firm*—James J. Ralabate

[57] ABSTRACT

A cold weather sports glove with finger compartment with closure means on at least the thumb and one or more of the compartment to allow the finger and thumb to extend outward for use. Means on the glove to hold the compartment in fixed position when the finger and thumb is in use.

14 Claims, 5 Drawing Figures

GLOVE

This invention relates to a sports glove and, more particularly, to a sports glove useful in cold or inclement weather.

BACKGROUND OF THE INVENTION

In several winter sports it is desirable to use gloves that permit use of one or more fingers to manipulate various sporting gear or equipment. In hunting, for example, it would be necessary for the hunter's index finger to be free to apply the necessary pressure to a trigger. In a like manner bowhunters require freedom of use of at least one finger and thumb to properly control the initial presentation of the arrow or other projecticle. Winter fishing is a sport where the use of one or more fingers is required for better control of the fishing rod, reel, line and affixing bait and the freedom of one or more fingers makes repeated casting of line from shore or boat much easier. While gloves are a necessity for these winter sports, gloves which permit freedom to use certain fingers and at the same time provide adequate warmth certainly make these sports more successful and enjoyable. It is clear that exposed fingers offer much better sensitivity to the sportsman.

There have been several attempts to provide sporting gloves particularly useful in cold weather, examples of such prior art gloves are those disclosed in U.S. Pat. Nos. 3,918,097; 4,408,358; and 4,445,507. In Mlodoch U.S. Pat. No. 3,918,097 a sport glove is disclosed which is designed specifically for use in golf. The glove has means to secure the holding of a golf club and means for grip retention. Mlodoch also teaches the use of VELCRO to restrain fingers on the glove from moving. The VELCRO or restraining means of the Mlodoch glove are positioned on the rear side of the finger stall so that a strap can engage these restraining means to hold the fingers in place and together. Mlodoch, however, is not suitable for winter sports where the fingers are needed to be free of the glove compartment for any period of time. Mlodoch has no provision for release of any fingers to manipulate a bow and arrow, fishing rod, applying bait or pulling a trigger and the like.

In the Swan U.S. Pat. No. 4,408,358 a cold weather sport glove is disclosed having the terminal portions of at least one finger open in order to expose that finger for conducting sporting activities. At least one finger of the Swan glove is in effect shortened in order to expose the finger when worn. Swan's glove is designed primarily for cold weather fishing and in particular fly fishing. In fly fishing it requires the pulling of a wet line through the fingers when retrieving the line after a cast. It is desirable to use gloves in this type activity which expose the thumb and index finger while keeping the remaining part of the hand covered and warm. Around the peripheral portion of the shortened glove finger, Swan provides a sealing means to limit, somewhat, cold air or water intrusion into the glove at the open end thereof. This sealing means of Swan comprises an inner annular circumferentially resilient member and an outer annular member of the same configuration. These annular members are made of nylon or polyurethane and are intended to be air and waterproof to keep the unexposed fingers warm. Unfortunately, in this type glove the exposed fingers remain uncovered during the duration of the glove wear and in many cases of extreme cold could become uncomfortable. In addition, while the seal is intended to protect the remaining unexposed fingers from air and water entering the glove, most sealing means are relatively uneffective against the seepage of water. Also, in the Swan glove, the wearer never has the option of which fingers to expose since the glove provides fixed and permanent shortened fingers and must always be worn in the same manner. Thus, there is no way to keep the entire hand and all fingers warm when using the Swan glove.

In Eisenberg's U.S. Pat. No. 4,445,507 a glove with a thumb resistant element is disclosed. Eisenberg's glove has a retainer disposed adjacent to the outside of thumb portion so as to restrict movement of the thumb portion away from the rest of the glove. In this way, damage is prevented to certain ligaments of the user's thumb should the thumb be bent abnormally. A zippered pocket located on the outside portion of Eisenberg's glove is used to insert or remove a protective thumb piece which is always used to prevent damage to the thumb. In lieu of a zippered pocket, Eisenberg discloses a glove wherein the protective means or trough could be placed inside a closed unzippered pocket which is then sewn onto the structure of an existing glove. There are no provisions in Eisenberg's glove for exposure of any fingers; the zippered means are only intended for insertion and removal of the thumb restraining means. Thus, this prior art type glove is not designed for use when warmth, flexibility and finger freedom are required.

SUMMARY OF THE INVENTION

It is therefore an object of this invention to provide a cold weather sporting gloove devoid of the above-noted disadvantages.

Another object of this invention is to provide a sporting glove that permits exposure of the fingers when needed for use and covering for these same fingers when not in use.

Still another object of this invention is to provide a cold weather glove that allows exposure of the fingers and means for securing the unused glove finger portions so that they do not obstruct or interfere with the manipulations of the free fingers.

Another still further object of this invention is to provide a glove where the wearer has the option of what fingers he would like to free from the gloves and expose for use.

Yet another object of this invention is to provide a glove having a means to free fingers but which may be worn as a conventional glove, if desired.

Still yet another object of this invention is to provide a glove with means for exposing selected fingers, but which also can maintain the entire hand enclosed and warm.

These and other objects of this invention are accomplished generally speaking by providing a sporting glove comprising a thumb, index finger, middle finger, ring finger and pinky finger compartment attached to a glove palm. Each of said fingers disposed in spaced unconnected relationship with the other and comprising an elongated tubular finger compartment. In the back portion of the glove are disposed retention means such as VELCRO fasteners for fold-locking finger compartments in place when a finger is exposed outside said compartment. In the front of at least one finger compartment and in the inner portion of the thumb compartment is a sealable or closeable opening through which at least one finger and the thumb can be extended outside the glove. This opening extends downwardly sufficient to permit the finger and thumb to extend therethrough. The opening can be provided with a zipper or other closure means for closing off the openings when the fingers are not required outside the glove. For example, when applying bait to a fish hook, the forefinger and thumb would be exposed outside the glove to accomplish attaching the bait to the hook, then the finger and thumb would be reinserted into the glove and the opening closed by a zipper or other suitable means. When the finger and thumb are outside the glove, their respective compartments are folded back and secured by mating VELCRO strips so that the finger portions (or tubular compartments) do not get in the way of the bait-attaching operation. While it is preferred that the thumb and index finger be provided with recloseable openings, any or all of the fingers may be so provided. It is however unusual that the wearer would use more than two fingers and thumb at one time. The glove of this invention unlike the prior art gloves provides means to extend fingers outside the glove but also provides for reinsertion of these fingers back into the glove finger compartments and said compartments made weatherproof by a tight closure means such as the preferred zipper. The glove of this invention is particularly adapted to cold weather fishing because it provides the wearer the option of exposing any finger and thumb and also the option of wearing the glove as he would a conventional glove. The glove of this invention can be constructed of any suitable material such as any of those used on conventional gloves, i.e. cloth, plastic, rubber, leather, rubber-coated fabrics, or mixtures thereof. The distal ends containing the opening through which the fingers protrude outwardly may be reinforced with nylon fabrics, leather or other strong materials on which a zipper or other closure means can be connected. The glove preferably is insulated to provide maximum warmth and weather proofing. The zipper closure means would preferably run straight down from the top or distal portion of the thumb and at least one finger to the glove portion just above the palm. When the zipper is opened, the thumb and finger portion of the glove are folded back individually and secured with VELCRO to the back portion of the glove. This will allow, as noted above, the wearer to expose thumb and finger while the rest of the gloved hand is protected from the cold weather. Also, when tying fishing line or even when retrieving a cast, one would desire use of both hands with exposed thumb and forefinger. The right and left hand glove may both be constructed according to this invention but in actual use most likely the wearer whether left-handed or right-handed will require only one glove be used according to this invention. Other closure means than zippers and other securing means than VELCRO fasteners may be used if suitable. However, zippers and VELCRO are preferred because of ease of construction and effectiveness.

BRIEF DESCRIPTION OF THE DRAWINGS

Referring now to the drawings in reference to each figure.

DETAILED DESCRIPTION OF THE DRAWINGS AND PREFERRED EMBODIMENTS

Figure 1:
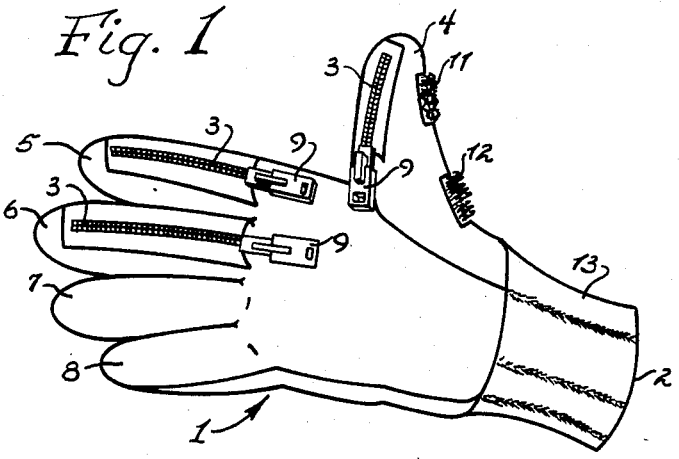
FIG. 1 is a perspective view of the glove of this invention.
Figure 2:
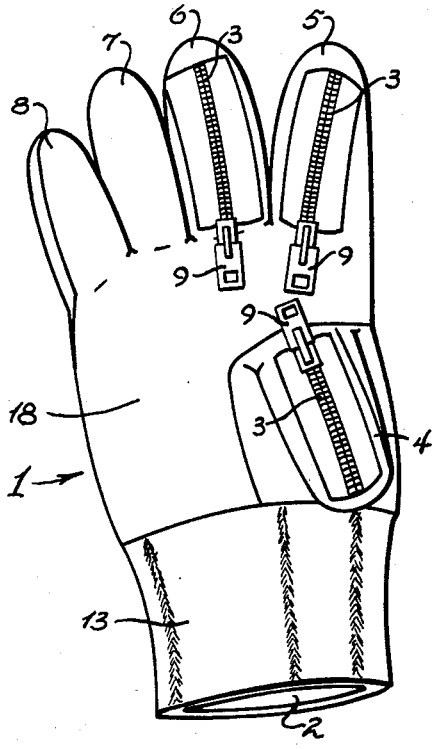
FIG. 2 is a front plan view of the glove of this invention with the thumb in an extended position.
Figure 3:
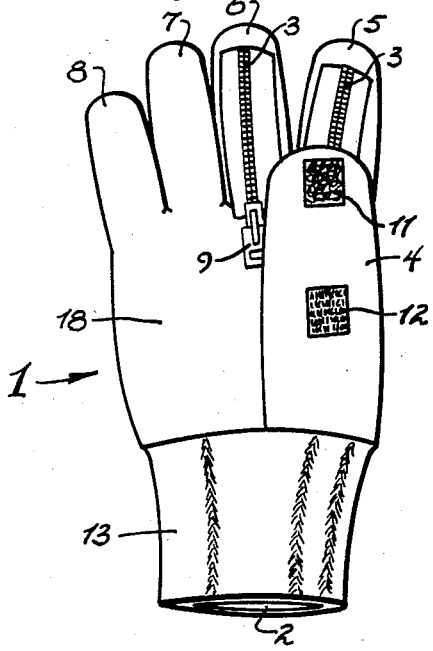
FIG. 3 is a front plan view of the glove of this invention with the thumb portion in its normal position.
Figure 4:
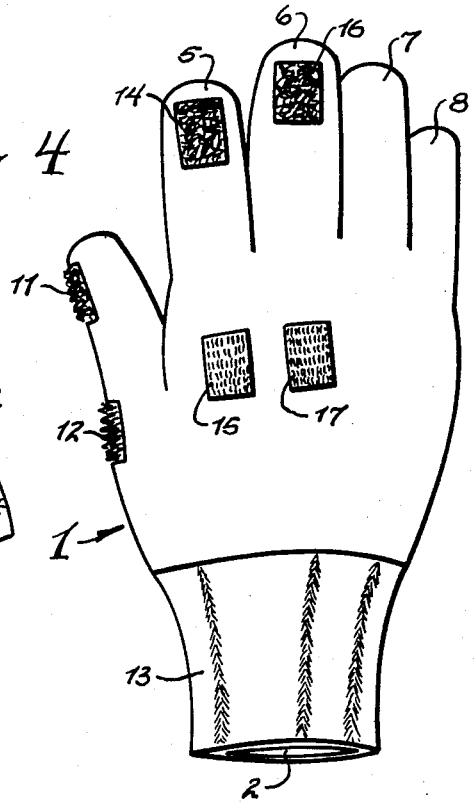
FIG. 4 is a back plan view of the glove of this invention.
Figure 5:
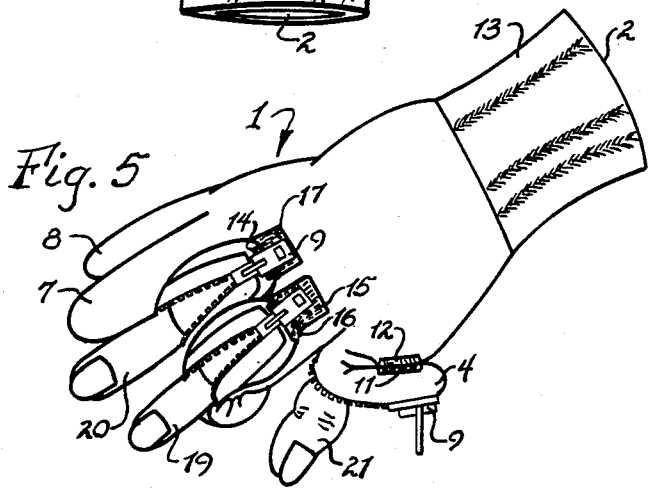
FIG. 5 is a perspective view of the glove of this invention with the wearer's thumb and fingers extending therefrom.

In FIG. 1 a perspective view of the glove 1 of this invention is shown. Glove 1 has a common entrance aperture 2 for insertion of the hand into the glove 1. On the inside portion of at least one finger (palm side of glove) are located closure means 3 which are zippers 3 in the preferred embodiment. All zippers in all figures are shown in the closed position except in FIG. 5 where they are shown open. While the drawing shows zippers 3 on two fingers and thumb zippers can be put on at least one finger and up to all four fingers if desired. The glove 1 as do conventional gloves contain a thumb compartment 4, an index finger compartment 5, a middle finger compartment 6, a ring finger compartment 7, and a pinky finger compartment 8. As zipper pulls 9 are pulled upwardly each of the zippered compartments opens to the atmosphere permitting the thumb or fingers to extend outwardly from the finger compartments or glove 1. When the thumb or fingers are outside the thumb or finger compartments, these respective finger or thumb compartments are folded back out of the way and fixed in position by securing means such as VELCRO fasteners 11 and 12 that are located at the distal back portions of the thumb and fingers as in thumb securing means 11 (finger-securing means shown in FIG. 4) and a mating VELCRO strip or thumb fastener 12 located in the back lower portion of the glove on the lower outside of each compartment. Thus, when each opened compartment is folded back such as in the thumb compartment, upper VELCRO fastener 11 will attach to lower VELCRO fastener 12 to hold compartment 4 out of the way and secured in position. The same arrangement is provided for each zippered finger compartment as shown in FIG. 5. A tight wrist portion 13 may be used to enhance the weatherproofing of each glove, if desired. In FIG. 2 a plan view of the front of the glove with the thumb compartment 4 extended downwardly for clarity is shown. It can be seen from the drawings that the zippers 3 are located on the inside of each compartment. Obviously, the zippers 3 (or other closure means) may be arranged in any manner that will provide easy opening of the compartments and secure closing to render the glove weatherproof when used as a conventional glove. As shown in FIGS. 2 and 4 only two finger compartments 5 and 6 and thumb compartment 4 are illustrated as having zippers 3 and VELCRO fasteners 11, 12, 14, 15, 16 and 17, however, it should be understood that from one to four finger compartments may be so provided. In FIG. 3 a front plan view of glove 1 is shown with the thumb compartment 4 in its normal position. The zipper 3 of the thumb compartment 4 is located at the inner portion of compartment 4 facing the palm 18 of the glove 1. VELCRO fasteners 11 and 12 are clearly shown at the back upper and lower portions of the thumb compartment 4. The compartment 4 would be folded at a point between fasteners 11 and 12 and VELCRO fasteners 11 and 12 would be locked together to hold compartment 4 in place (as shown in FIG. 5). All zippers 3 are preferably positioned in the fingers on the side of the palm portion 18.

However, if it was desired for any reason to put the zippers 3 on the reverse side of the glove, it would be considered to be within the scope and purview of this invention. The same can be said of VELCRO securing means. They can also be located on the side in reverse of that shown in the drawings. In any event, for ease of use it is preferred to have the zippers 3 on the same glove face as the palm 18 and the VELCRO fasteners on the reverse side. Also, the glove can have less than four fingers, if desirable. For example, with just an index finger compartment and a compartment to house the remaining three fingers. Each of these compartments or either of them may have a zipper closure means and VELCRO securing means. Also, it is possible to use a mitten-type arrangement with VELCRO fasteners on the back and zipper means in the front portion of the glove. In the mitten-type arrangement, the thumb and at least one finger would be exposed. The remaining fingers would be then housed in one compartment. It is preferred, however, for optimum efficiency, to use a glove with a thumb compartment and four finger compartments. In FIG. 4 the back portion of glove 1 is shown illustrating the positions of the upper and lower VELCRO fasteners on the glove 1. Each compartment 4, 5 and 6 would be folded back at a fold point somewhere between VELCRO fasteners 11 and 12 for the thumb, 14 and 15 for index finger compartment 5 and 16 and 17 for the middle finger compartment 6. In FIG. 5 the glove 1 is shown when worn with the wearer's thumb 21, index finger 19 and middle finger 20 outside the thumb and finger compartments. Thumb compartment 4 is folded back out of place and secured in place by VELCRO means 11 and 12. Index finger compartment 5 is folded back and secured in place on the back of glove 1 by VELCRO fasteners 14 and 15. Middle finger compartment 6 is folded back and secured in place by VELCRO fasteners 16 and 17. After the activity requiring finger freedom is completed, (such as baiting a fishing hook) the fingers and thumb are reinserted into the glove compartments 4, 5 and 6 and each zippered up to again render the glove weatherproof.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A cold weather sports glove comprising a thumb compartment and at least one finger compartment, said thumb and finger compartments having on a first side thereof a closure means and on a second side of said glove a compartment securing means, said closure means adapted to be opened to allow a thumb or at least one finger to extend outwardly therefrom and subsequently adapted to be closed to render said glove substantially weatherproof, said securing means adapted to fix a compartment in position as the thumb and at least one finger are extended out of said compartments.

2. The glove of claim 1 having positioned therein a thumb compartment and at least two finger compartments.

3. The glove of claim 1 wherein said closure means are positioned in at least one finger compartment on the same face of said glove as is the palm portion surface.

4. The glove of claim 1 wherein said securing means are positioned in at least one finger compartment on the opposite face of said glove as is the palm portion.

5. The glove of claim 1 wherein said closure means are zippers located in at least one finger compartment of said glove and in said thumb compartment.

6. The glove of claim 1 wherein said securing means are VELCRO fasteners located in at least one finger compartment of said glove and in said thumb compartment.

7. The glove of claim 1 wherein said securing means are pairs of VELCRO fasteners located in at least one finger compartment, said fasteners adapted to mate with each other to fix said compartment in position when said closure means are in the open mode.

8. The glove of claim 1 having a substantially weatherproof wrist portion which encloses a hand entrance aperture.

9. A cold weather sports glove comprising an entrance aperture, and tubular compartments for a thumb and four fingers, said compartment for a thumb having on its inner surface facing a palm portion of said glove a zipper closure means and on its outer surface facing away from said palm portion having VELCRO fastener securing means, at least one compartment for the fingers having on its inner surface which is the same as the palm surface of said glove zipper closure means and on its outer surface opposite to said palm portion having VELCRO surface securing means, said zipper closure being of sufficient size to permit the thumb and at least one finger to be extended from each respective compartment, said securing means adapted to fix a compartment in position as the thumb and at least one finger are extended out of said compartments.

10. The glove of claim 9 wherein a closure means and a securing means are positioned on two finger compartments.

11. The glove of claim 9 wherein a closure means and a securing means are positioned on one finger compartment.

12. The glove of claim 9 wherein said securing means comprises on each compartment with a closure means an upper VELCRO strip and a lower VELCRO strip, said securing VELCRO strips adapted to overlay each other and fix the respective compartments in place when said closure means are in the open mode.

13. The glove of claim 9 wherein said securing means comprises on each compartment with a closure means a VELCRO strip located on the distal portion of said compartment and a mating VELCRO strip located on the lower portion of said compartment, each adapted to overlay the other to fix the compartment in place when said closure means are in the open mode.

14. The glove of claim 9 wherein said closure means are of sufficient length to permit the thumb and at least one finger to be extended therefrom.

* * * * *